United States Patent [19]

Richardson

[11] Patent Number: 5,064,398

[45] Date of Patent: Nov. 12, 1991

[54] CARRYING CASE FOR PEA CHARACTERS

[76] Inventor: Lee Richardson, 205 Kenrich Dr., Coraopolis, Pa. 15108

[21] Appl. No.: 687,598

[22] Filed: Apr. 19, 1991

[51] Int. Cl.[5] ..... A63H 33/00; B65D 69/00

[52] U.S. Cl. ..... 446/75; 446/73; 206/457

[58] Field of Search ..... 446/73, 75, 72, 268; 206/45.31, 457, 470; 220/DIG. 13; 229/2.5 R

[56] References Cited

U.S. PATENT DOCUMENTS 3,300,039 1/1967 Pilger ..... 206/45.31

3,362,605 1/1968 Bixler ..... 206/45.31 X 4,527,688 7/1985 Jones et al. ..... 446/75 X 5,013,278 5/1991 Dixon et al. ..... 446/73

*Primary Examiner*—Mickey Yu

*Attorney, Agent, or Firm*—H. Jay Spiegel

[57] ABSTRACT

A carrying case is disclosed which has the general outward appearance of a pea pod but with the provision of a hinge, a handle and an interior chamber designed to store a plurality of toys which resemble peas. A corresponding plurality of openings in one wall of the carrying case allow one to view the toys from outside the carrying case.

6 Claims, 2 Drawing Sheets

CARRYING CASE FOR PEA CHARACTERS

BACKGROUND OF THE INVENTION

The present invention relates to a carrying case for pea characters. In the prior art, carrying cases for toys and toy characters are known. However, Applicant is unaware of any such device including all of the aspects and features of the present invention. The following prior art is known to Applicant:

British Patent Specification 1257666 to Reynolds discloses embodiments of toys which comprise simulations of known food products. For example, the embodiment of FIG. 3 thereof discloses a simulated banana including a skin which may be opened to reveal banana slices. Of course, this is different from the teachings of the present invention which contemplates a carrying case having a handle and including openings allowing viewing of toy pea characters inside the case.

U.S. Pat. No. 1,453,351 to Webb discloses a toy consisting of a simulated chicken having chicks contained within a base made to resemble a nest. The Webb device may in no way be construed as being a carrying case.

British Patent Specification 2051593 to Wilkins discloses a device including a nest designed to contain a plurality of furry characters. Of course, the Wilkins device may in no way be construed as a carrying case nor does the Wilkins device include individual openings for viewing the individual toys.

U.S. Pat. No. 4,435,915 to Zaruba et al. discloses a doll house having openings through which may be viewed individual characters as best seen in FIG. 1 thereof. However, the Zaruba et al. device may in no way be construed as a carrying case nor does it include chambers which closely fit around the toy characters.

U.S. Pat. No. 4,739,129 to Gorley et al. discloses an artificial vine with individual leaves thereof having contained therein articles such as dolls. Of course, the Gorley et al. device may in no way be construed as a carrying case in the manner contemplated by the present invention nor do Gorley et al. contemplate chambers designed to closely receive toy pea characters.

U.S. Pat. No. 4,950,194 to Gullace discloses dolls made in simulative plant-like configurations. Of course, the present invention differs from the teachings of Gullace as contemplating a carrying case designed to store, for transport, a plurality of pea-shaped characters while allowing them to be visible from outside the carrying case.

U.S. Pat. No. 4,954,114 to Kawashima discloses a toy consisting of a plurality of characters made of soft materials and simulating peas and designed to be stored in a casing made to resemble a pea pod. The present invention differs from the teachings of this patent as including container structure consisting of a subchamber for each pea toy and including an individual opening in one wall of the container for viewing of each individual pea toy.

SUMMARY OF THE INVENTION

The present invention relates to a carrying case for pea characters. The present invention includes the following interrelated objects, aspects and features:

(1) In a first aspect, the present invention consists of a carrying case having a plurality of subchambers formed therein when the halves of the carrying case are pivoted to a closed position thereof.

(2) Each subchamber is sized and configured to snugly receive a toy simulating a pea.

(3) The carrying case consists of two halves pivoted together and including a handle formed by both halves when they are pivoted to the closed position of the carrying case. One of the halves of the carrying case includes a wall with a number of openings therethrough corresponding to the number of subchambers in the carrying case, with each opening being aligned with a respective subchamber.

(4) When pea characters are placed within the individual subchambers and the carrying case is closed, each individual pea character toy is visible through a respective opening in the carrying case.

As such, it is a first object of the present invention to provide an improved carrying case for pea characters.

It is a further object of the present invention to provide such a device wherein pea character toys are stored within individual subchambers within the carrying case.

It is a yet further object of the present invention to provide such a device wherein each pea character is visible through a wall of the carrying case.

These and other objects, aspects and features of the present invention will be better understood from the following detailed description of the preferred embodiment when read in conjunction with the appended drawing figures.

SPECIFIC DESCRIPTION OF THE PREFERRED EMBODIMENTS

Figure 1:
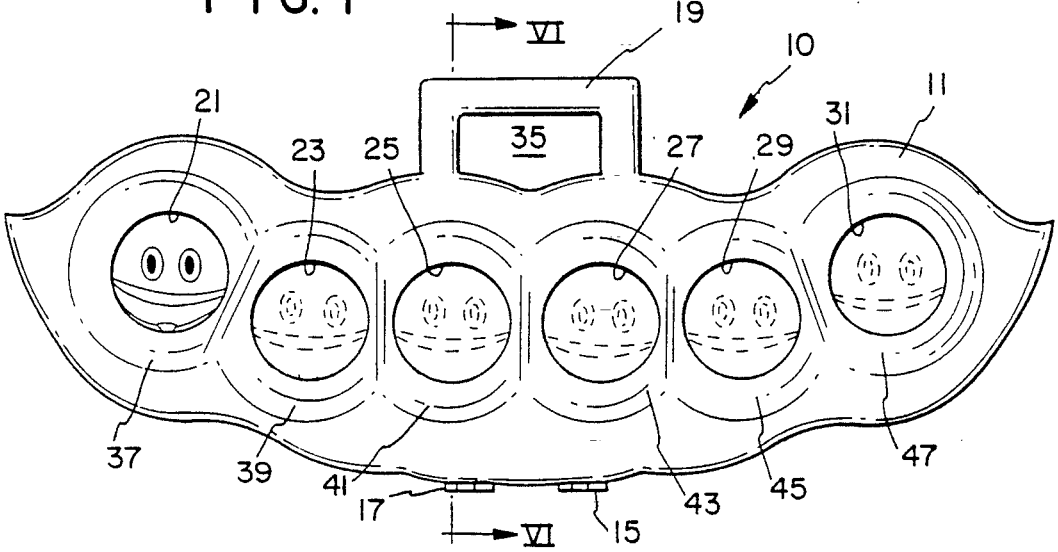
FIG. 1 shows a front view of the present invention.
Figure 2:
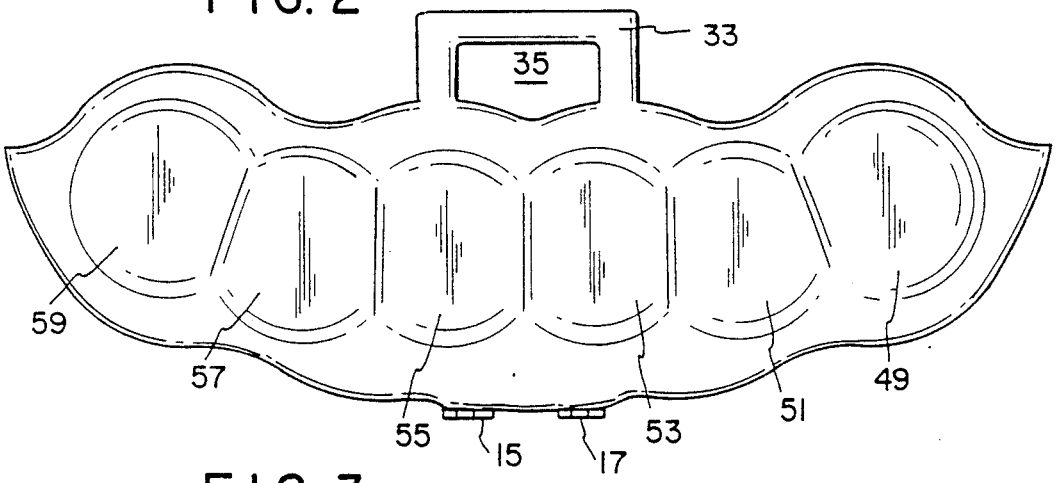
FIG. 2 shows a rear view of the present invention.
Figure 3:
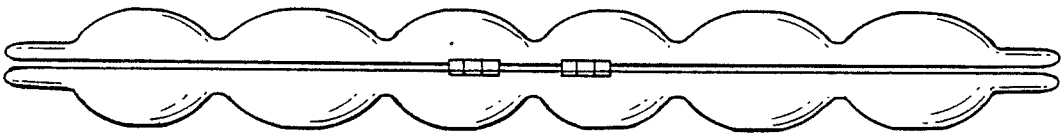
FIG. 3 shows a bottom view of the present invention.
Figure 4:
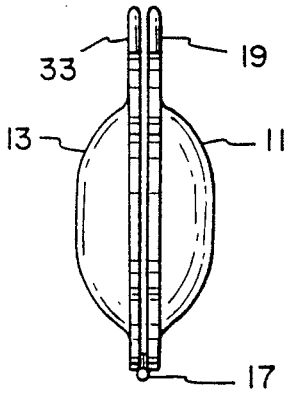
FIG. 4 shows an end view of the present invention.
Figure 5:
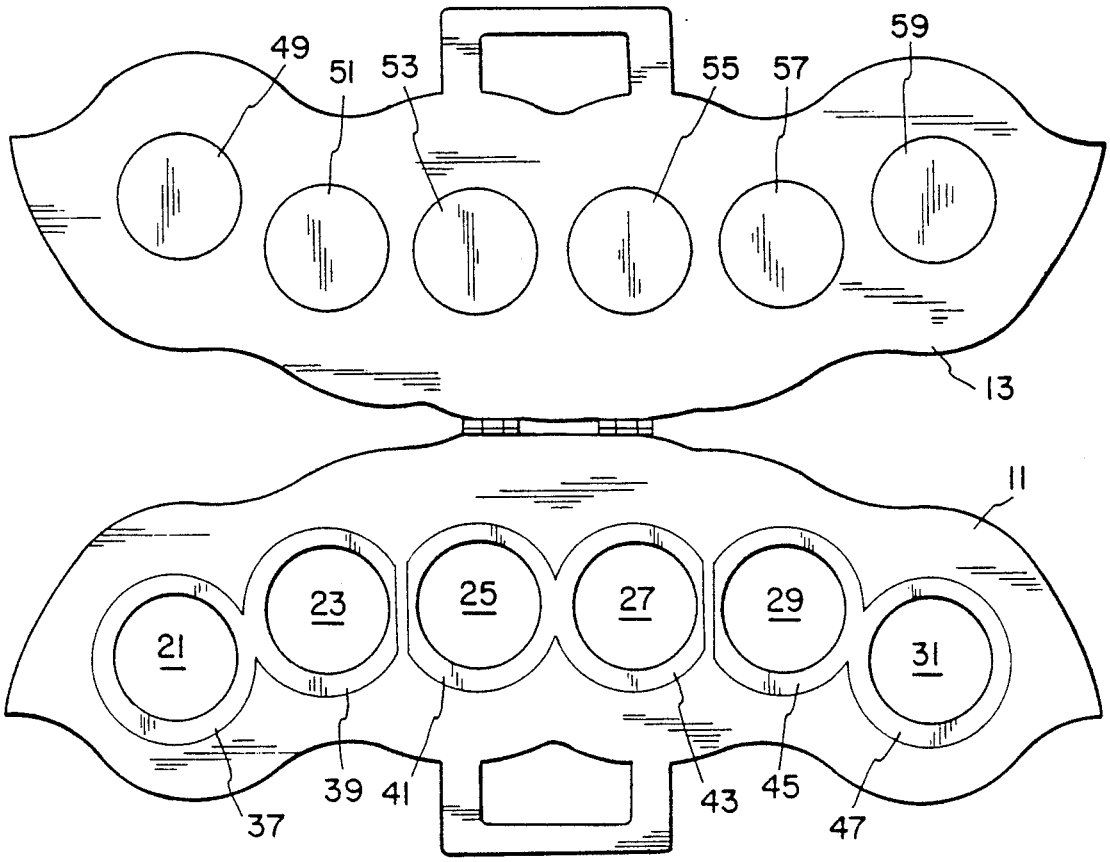
FIG. 5 shows a view of the present invention in an open configuration thereof.

With reference to FIGS. 1 and 2, the inventive carrying case is generally designated by the reference numeral 10 and is seen to include a front half 11, a rear half 13 and hinges 15, 17 which mount the halves for pivoting movement with respect to one another between the closed position shown in FIGS. 1–4 and the open position shown in FIG. 5.

FIG. 1 shows the front half 11 to include a handle half 19 as well as openings 21, 23, 25, 27, 29 and 31 therein. These openings are provided for a purpose to be described in greater detail hereinafter.

The rear half 13 is seen to include a handle half 33 which combines with the handle half 19 as best seen in FIG. 4 to provide a carrying handle having an opening 35 therethrough through which the fingers of the user may extend to allow gripping the handle 19, 33 to carry the carrying case 10.

With further reference back to FIG. 1, it is seen that surrounding each opening is a bulbous structure with these bulbous structures being respectively referred to with the reference numerals 37, 39, 41, 43, 45 and 47. In this regard, FIG. 6 shows the opening 25 and the bulbous structure 41.

With reference to FIG. 2, it is seen that a corresponding plurality of bulbous structures are provided and are generally designated by the reference numerals 49, 51, 53, 55, 57 and 59. FIG. 6 shows the bulbous structure 53 which is aligned with the bulbous structure 41 of the front half 11.

Figure 6:
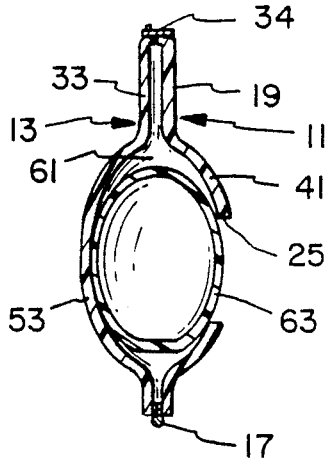
FIG. 6 shows a cross-sectional view along the line VI—VI of FIG. 1.

As should be understood, with reference to FIG. 6 in particular, the bulbous portions of the front and rear halves of the carrying case create interior subchambers within the carrying case of which the subchamber formed by the bulbous portions 41, 53 is designated by the reference numeral 61. With reference to FIG. 6, it is seen that the subchamber 61 is sized and configured to snugly receive a generally spherical toy 63 which may be made to resemble a pea as if contained within a pod, with the pea toy 63 having a design thereon making the toy 63 a pea character. Each subchamber of the inventive carrying case 10 is similarly sized and configured to removably receive a similarly sized and configured toy having a diverse design thereon so that, in the preferred embodiment of the present invention, each subchamber contains a pea toy with each pea toy having a unique ornamental appearance. As should be understood from FIGS. 1 and 6, when the toy 63 is placed within the subchamber with the character face aligned with the opening 25, when the carrying case is in the closed position illustrated in FIGS. 1 through 4, the face of the pea character will be visible through the opening 25. In a similar way, each character toy face will be visible through a respective one of the openings 21, 23, 25, 27, 29 and 31.

FIG. 5 shows the carrying case in the opened position thereof with the openings 21, 23, 25, 27, 29 and 31 visible as well as the respective bulbous portions 37, 39, 41, 43, 45 and 47 surrounding these respective openings.

In a similar fashion, the bulbous portions 49, 51, 53, 55, 57 and 59 of the half 13 are also visible from the inside in FIG. 5.

With the above description in mind, the operation and use of the present invention should be clearly understood. In the position of the device shown in FIG. 5, six pea character toys may be placed within one or the other half of the container within the bulbous portions thereof but with the face of each character aligned in such a way that when the case is closed, the face will be visible through the openings in the half 11.

With these toys so situated therewithin, the halves 11, 13 may be pivoted about the hinges 15, 17 to cause the carrying case 10 to assume the closed position best seen in FIGS. 3 and 4 with a latch mechanism 34 best seen in FIG. 6 and consisting of, if desired, a swinging hook engaging an upstanding post, being used to retain the halves 11, 13 in the closed configuration thereof as best seen in FIGS. 3, 4, and 6. In this position, the user may grip the handle formed by the handle halves 19, 33 and may carry the carrying case as desired. In this configuration, as described above, the faces of the respective pea character toys are visible through the respective openings 21, 23, 25, 27, 29 and 31 so that they may be viewed from outside the carrying case.

In the preferred embodiment of the present invention, the components of the inventive carrying case except for the hinges 15, 17 and the latch 34 may be made of molded plastic. Of course, these components may, alternatively, be made of a material such as wood or light metal.

In the preferred embodiment, the character toys themselves may be made of plastic, wood, metal or any desired material.

When carrying the device, it appears that one is carrying peas in a pod with the peas being clearly visible from outside for aesthetic purpose.

As such, an invention has been disclosed in terms of a preferred embodiment thereof which fulfills each and every one of the objects of the present invention as set forth above and provides and new and useful carrying case of great novelty and utility. Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A carrying case, comprising:

a) an elongated housing having a first half and a second half;

b) said first half having a plurality of adjacent generally semi-spherical first recesses therein, each recess having an opening therethrough;

c) said second half having a plurality of adjacent generally semi-spherical second recesses therein;

d) said carrying case having a closed configuration with said halves adjacent one another and with respective first recesses combining with respective second recesses to form respective generally spherical subchambers;

e) each said subchamber being sized and configured to closely receive a toy made to resemble a pea and including character features including a distinct face visible through said opening;

f) said case having a carrying handle;

g) said carrying case in said closed configuration thereof, having an outer shape including one generally arcuate side opposite said handle and another side opposite said one side and having a series of undulating curves to either lateral side of and beneath said handle, said sides being connected.

2. The invention of claim 1, wherein in said closed configuration, said case resembles a pea pod.

3. The invention of claim 1, wherein said halves are hingedly connected for relative pivoting movements, and further including a latch which, when engaged, maintains said case in said closed configuration.

4. The invention of claim 1, wherein said handle includes a first handle half on said first half of said casing and a second handle half on said second half of said casing.

5. The invention of claim 1, in combination with at least one toy contained with one of said subchambers.

6. A carrying case, comprising:

a) an elongated housing having a first half and a second half;

b) said first half having a plurality of adjacent generally semi-spherical first recesses therein;

c) said second half having a plurality of adjacent generally semi-spherical second recesses therein;

d) said carrying case having a closed configuration with said halves adjacent one another and with respective first recesses combining with respective second recesses to form respective generally spherical subchambers;

e) each said subchamber being sized and configured to closely receive a toy made to resemble a pea and including character features including a distinct face; and f) said case having a carrying handle;

g) said carrying case, in said closed configuration thereof, having an outer shape including one generally arcuate side opposite said handle and another side opposite said one side and having a series of undulating curves to either lateral side of and beneath said handle, said sides being connected.

* * * * *